US009601855B2

(12) United States Patent
Kashiwada et al.

(10) Patent No.: US 9,601,855 B2
(45) Date of Patent: Mar. 21, 2017

(54) FEMALE TERMINAL

(71) Applicant: Sumitomo Wiring Systems, Ltd., Yokkaichi, Mie (JP)

(72) Inventors: Tomokazu Kashiwada, Mie (JP); Masafumi Uno, Mie (JP); Kiyotaka Itsuki, Mie (JP)

(73) Assignee: SUMITOMO WIRING SYSTEMS, LTD., Yokkaichi-Mie (JP)

( * ) Notice: Subject to any disclaimer, the term of this patent is extended or adjusted under 35 U.S.C. 154(b) by 0 days.

(21) Appl. No.: 14/691,627

(22) Filed: Apr. 21, 2015

(65) Prior Publication Data

US 2015/0333428 A1 Nov. 19, 2015

(30) Foreign Application Priority Data

May 14, 2014 (JP) ..... 2014-100613

(51) Int. Cl.
*H01R 13/11* (2006.01)
*H01R 13/115* (2006.01)
*H01R 13/52* (2006.01)

(52) U.S. Cl.
CPC ..... *H01R 13/115* (2013.01); *H01R 13/113* (2013.01); *H01R 13/5202* (2013.01)

(58) Field of Classification Search
CPC .. H01R 13/187; H01R 13/113; H01R 13/115; H01R 4/185
USPC ..... 439/845, 852
See application file for complete search history.

(56) References Cited

U.S. PATENT DOCUMENTS 3,784,955 A * 1/1974 Reynolds ..... H01R 12/728 439/79
5,685,746 A 11/1997 Maejima
5,947,777 A * 9/1999 Chaillot ..... H01R 13/113 439/852
6,193,567 B1 * 2/2001 Hsieh ..... H01R 9/091 439/84
6,547,608 B2 4/2003 Sato
7,175,487 B2 * 2/2007 Urbaniak ..... H01R 4/185 439/852

(Continued)

FOREIGN PATENT DOCUMENTS

DE 2203435 A1 8/1972
GB 2314468 A 12/1997

(Continued)

OTHER PUBLICATIONS

German Office Action Dated Dec. 16, 2015.

*Primary Examiner* — Hien Vu
(74) *Attorney, Agent, or Firm* — Gerald E. Hespos; Michael J. Porco; Matthew T. Hespos

(57) ABSTRACT

A female terminal (40) to be connected to a male terminal (80) includes a tubular portion (41) configured by a plurality of peripheral walls. Resilient pieces (46, 47) extend in a front-back direction while facing the peripheral walls in the tubular portion (41). Excessive deflection preventing portions (90, 91) are provided on the peripheral walls, including a front abutting portion (92) and a rear abutting portion (93) arranged behind the front abutting portion (92), and configured to prevent the resilient pieces (46, 47) from being deflected excessively by contacting the resilient pieces (46, 47) at both the front and rear abutting portions (92, 93).

11 Claims, 13 Drawing Sheets

(56) References Cited

U.S. PATENT DOCUMENTS 8,827,754 B2 * 9/2014 Lee ..... H01R 13/113
439/843

FOREIGN PATENT DOCUMENTS

| | | | |
|---|---|---|---|
| JP | 10321278 | A | 4/1998 |
| JP | 200263961 | A | 2/2002 |
| JP | 2006107934 | A | 4/2006 |
| WO | 9923723 | A | 5/1999 |

* cited by examiner

FEMALE TERMINAL

BACKGROUND

1. Field of the Invention

A technology disclosed by this specification relates to a female terminal.

2. Description of the Related Art

U.S. Pat. No. 5,685,746 discloses a female terminal to be connected to a plate-like male terminal. This female terminal includes an electrical connecting portion that resiliently sandwiches the plate-like male terminal, a wire connecting portion to be connected to an end of a wire and a protection member for covering the electrical connecting portion. The electrical connecting portion has two pairs of resilient pieces on upper and lower side walls of a tubular base and bent to have a rectangular cross-section. The resilient piece is inclined in to a front side from the side wall and a tip part thereof is bent out into an arcuate shape.

However, the above-described female terminal does not have excessive deflection preventing pieces for preventing excessive deflection of each resilient piece when a load is applied to each resilient piece, such as due to the rolling of the male terminal. Excessive deflection preventing pieces could be formed by cutting and bending parts of upper and lower walls of the protection member. However, the resilient pieces would be supported at one position by the excessive deflection preventing pieces. As a result, seated postures of the resilient pieces on the excessive deflection preventing pieces become unstable and a contact pressure with the male terminal becomes unstable. Further, a stress received from the excessive deflection preventing piece by the resilient piece is concentrated on one position. Thus, the contact pressure with the male terminal varies when the resilient piece is deformed plastically.

Accordingly, an object of this disclosure is to maintain performance of a resilient piece within a range where the resilient piece is not deformed plastically.

SUMMARY

One aspect of the invention relates to a female terminal to be connected to a male terminal. The female terminal includes a tubular portion and at least one resilient piece extending in a front-back direction while substantially facing a peripheral wall in the tubular portion. At least one excessive deflection preventing portion is provided on the peripheral wall. The excessive deflection preventing portion includes front and rear abutting portions configured to prevent the resilient piece from being deflected excessively by contacting the resilient piece at both the front and rear abutting portions.

Excessive deflection of the resilient piece is prevented at two positions, namely, at the front and rear abutting portions of the excessive deflection preventing portion. Thus, a seated posture of the resilient piece on the excessive deflection preventing portion is stable. More particularly, if the resilient piece contacts an abutting portion at only one position, the resilient piece is deflected easily at opposite front and rear ends of this abutting portion. However, in accordance with the invention, the resilient piece contacts abutting portions at two positions, and extends along a substantially straight line connecting the abutting portions. Therefore, excessive deflection of the resilient piece is prevented at least between the abutting portions.

Further, a stress is distributed more when the resilient piece contacts the abutting portions at two positions than when it contacts the abutting portion at only one position. Thus, the resilient piece is difficult to deflect and difficult to deform plastically at each abutting portion. Furthermore, a displacement amount associated with the deflection of the resilient piece becomes smaller and a contact pressure with the male terminal becomes stable. Therefore, the performance of the resilient piece can be maintained within a range where the resilient piece is not deformed plastically.

The tubular portion may have a plurality of peripheral walls.

The resilient piece may include a contact portion configured to resiliently come into contact with the male terminal, and either one of the front and rear abutting portions may come into contact with the contact portion from a side substantially opposite to the male terminal.

Since the contact pressure with the male terminal is a pressure applied from the contact portion of the resilient piece to press the male terminal, a displacement of the contact portion is suppressed and the contact pressure with the male terminal becomes more stable by the contact of either one of the abutting portions with the contact portion.

Further particularly, either one of the front and rear abutting portions may substantially come into line contact with the contact portion from the side substantially opposite to the male terminal.

According to such a configuration, the rolling of the resilient piece at the position of the contact portion (seesaw-like swinging movements of opposite lateral parts of the resilient piece when viewed in an inserting direction of the male terminal) is suppressed, wherefore the seated position of the resilient piece on the excessive deflection preventing portion becomes more stable.

The excessive deflection preventing portion may include an abutting surface between the front and rear abutting portions. The abutting surface is configured to come into surface contact with the resilient piece. Thus, stress applied by the resilient piece to the excessive deflection preventing portion is distributed widely.

The excessive deflection preventing portion may be formed by striking a part of the peripheral wall toward the resilient piece. Forming the excessive deflection preventing portion by striking enhances the rigidity of the excessive deflection preventing portion as compared with the case where the excessive deflection preventing portion is formed by cutting and bending.

Two resilient pieces may be provided to resiliently sandwich the male terminal. Thus, even if the male terminal is displaced in a deflecting direction of the resilient piece and a contact pressure from one resilient piece is reduced, a contact pressure from the other resilient piece is increased. Thus, a reduction of the contact pressure can be prevented regardless of the displacement of the male terminal.

These and other features and advantages of the invention will become more apparent upon reading the following detailed description of preferred embodiments and accompanying drawings. Even though embodiments are described separately, single features may combine with other embodiments or used separately.

DETAILED DESCRIPTION

Figure 1:
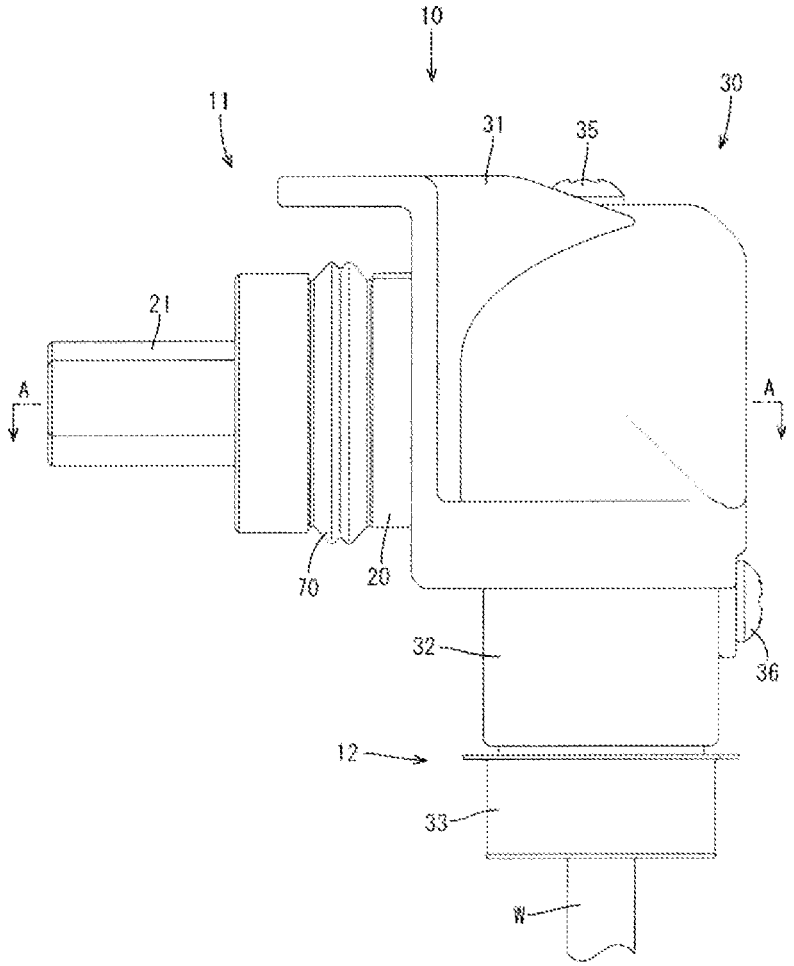
FIG. 1 is a side view of a shield connector.
Figure 2:
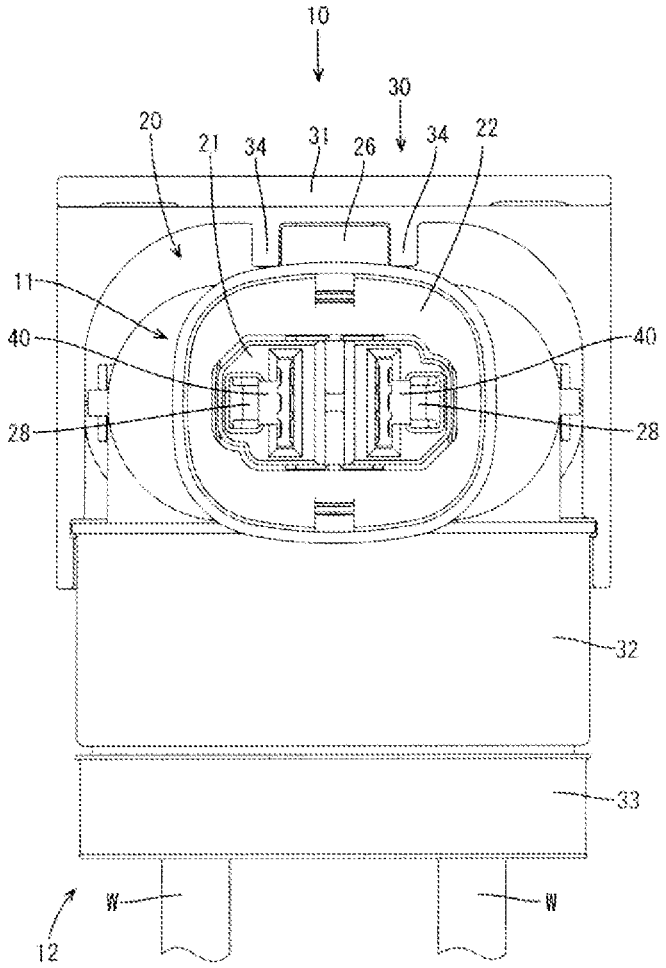
FIG. 2 is a front view of the shield connector.
Figure 3:
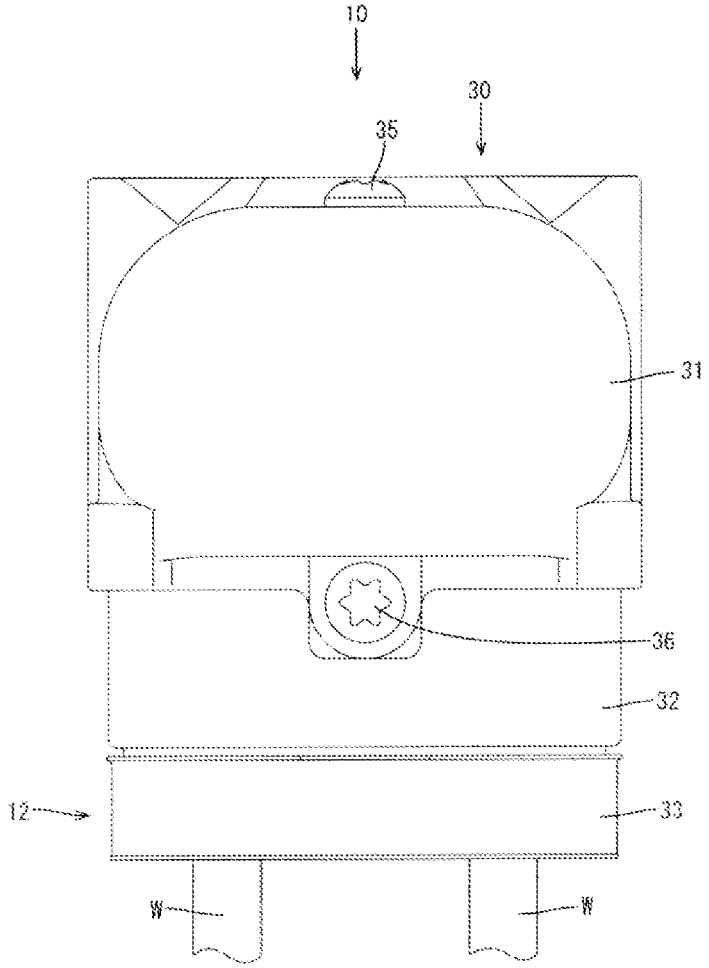
FIG. 3 is a rear view of the shield connector.
Figure 4:
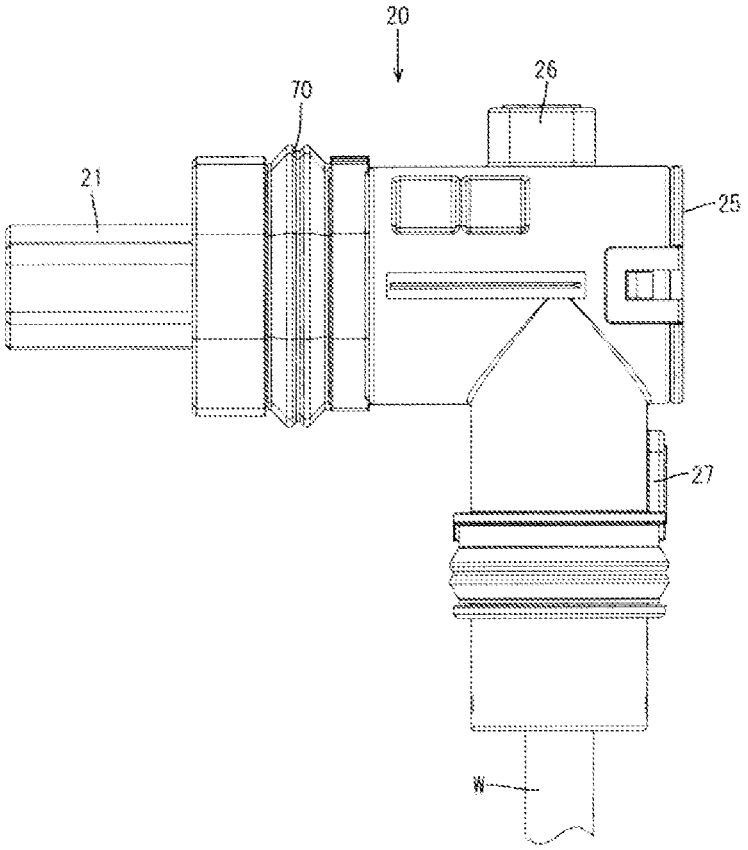
FIG. 4 is a side view of the shield connector before a shield shell is mounted.

A shield connector in accordance with an embodiment is identified generally by the number 10 in FIGS. 1 to 12. The connector 10 includes a housing 20 that is substantially L-shaped in a side view. A shield shell 30 at least partly surrounds the housing 20 and wires W are drawn out from the housing 20, as shown in FIGS. 1 to 3. In the following description, a connection side with an unillustrated mating connector (left side in FIG. 1) is referred to as a front, a vertical direction is based on that of FIG. 2 and a width direction is based on a lateral direction of FIG. 2.

Figure 7:
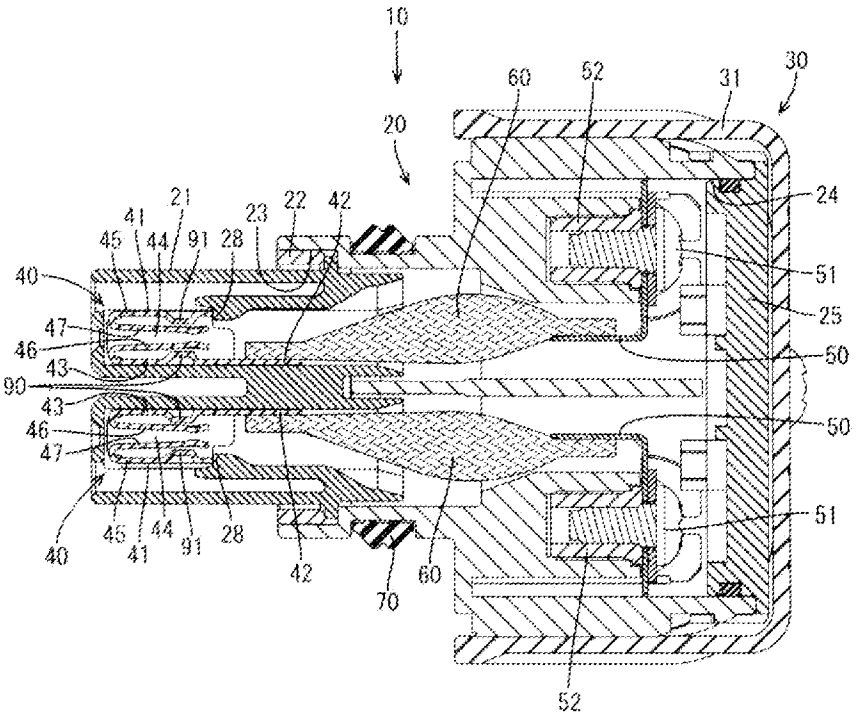
FIG. 7 is a section along A-A of FIG. 1.

A connector fitting portion 11 is formed on a front end of the shield connector 10 and can fit into a mounting hole (not shown) formed on a case of a device. A wire draw-out portion 12 is formed on a lower end of the shield connector 10 and wires W are drawn out therefrom. A floating housing 21 is assembled with the connector fitting portion 11. As shown in FIG. 7, the floating housing 21 is held in a state retained by a retainer 22 so as not to come out forward. The floating housing 21 is mounted with a specified clearance defined between the floating housing 21 and a front end opening 23 of the housing 20 and is loosely movable in the vertical and/or lateral directions along directions intersecting a connecting direction within the range of this clearance.

Female terminals 40 are held in the floating housing 21. On the other hand, L-shaped intermediate terminals 50 are held by bolts 51 in the housing 20. The female terminal 40 and the intermediate terminal 50 are connected by a braided wire 60. The braided wire 60 is formed into a tubular shape by braiding metal strands and bulges out between the female terminal 40 and the intermediate terminal 50.

A cap with a seal 25 is fit to a rear end opening 24 of the housing 20. An operation of tightening the bolt 51 into a nut 52 is performed by inserting a tool into the interior of the housing 20 through the rear end opening 24. After fastening, the rear end opening 24 is closed in a sealed state by the cap with the seal 25. On the other hand, an annular seal ring 70 is fit on a side of the housing 20 behind the front end opening 23. This seal ring 70 is sandwiched between the inner peripheral surface of the mounting hole of the device and the outer peripheral surface of the housing 20 to seal the interior of the housing 20.

As shown in FIG. 2, the shield shell 30 comprises an aluminum die cast upper shell 31, a lower shell 32 formed by press-working a metal plate and a caulk ring 33 caulked to a lower part of the lower shell 32. Wires W are drawn out from the lower shell 32, and a braided wire (not shown) for collectively shielding the wires W is crimped on the lower part of the lower shell 32 by the caulk ring 33.

An upper shell fixing portion 26 is formed on the upper surface of the housing 20, and the upper shell 31 is formed with guide rails 34 arranged at opposite left and right sides of the upper shell fixing portion 26. The upper shell fixing portion 26 is inserted between the guide rails 34A to guide movement of the upper shell 31 onto the housing 20 from behind.

Figure 5:
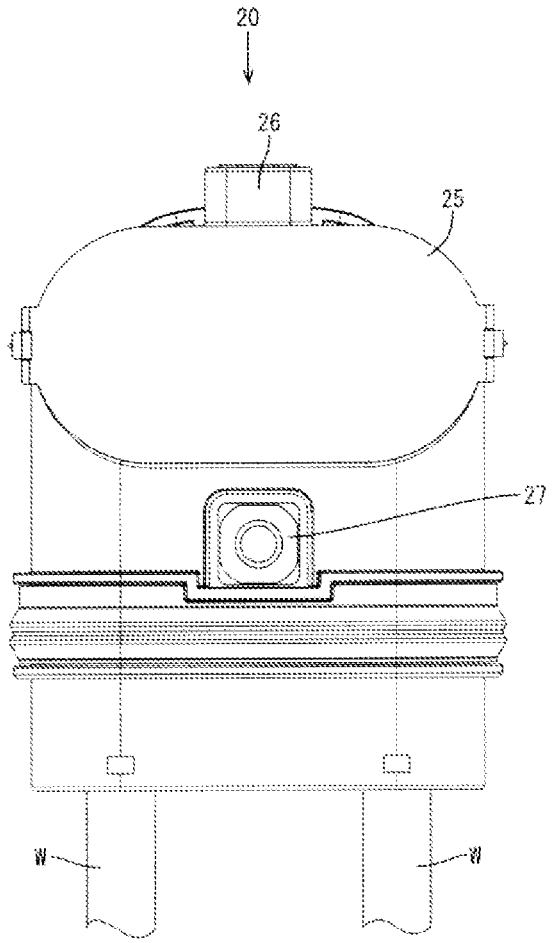
FIG. 5 is a rear view of the shield connector before the shield shell is mounted.
Figure 6:
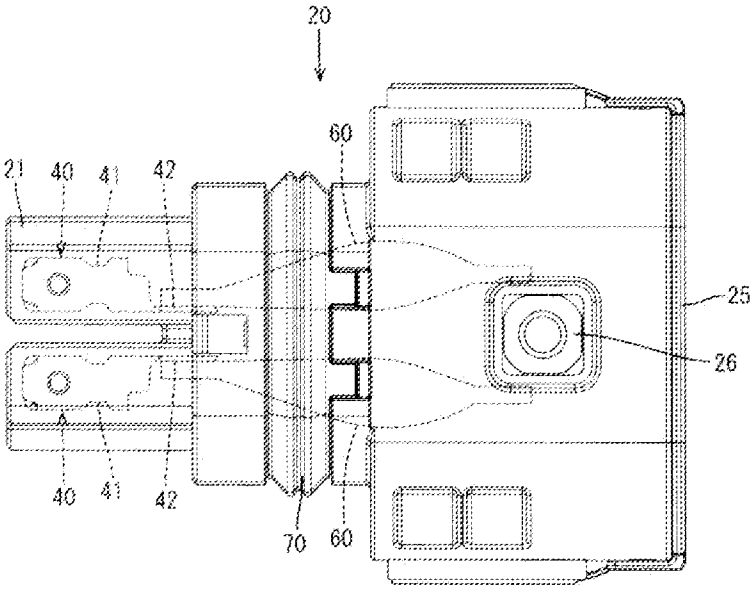
FIG. 6 is a plan view of the shield connector before the shield shell is mounted.

A lower shell fixing portion 27 is formed on the rear surface of the housing 20, as shown in FIG. 5, and the upper shell 31 and the lower shell 32 are fastened together and fixed to the lower shell fixing portion 27 by a lower bolt 36, as shown in FIG. 1. On the other hand, the upper shell 31 is fixed singly to the upper shell fixing portion 26 by an upper bolt 35.

The configuration of the female terminal 40 is described with reference to FIGS. 7 to 9. The female terminal 40 is formed by bending a metal plate that has been punched out into a predetermined shape. The female terminal 40 includes a rectangular tube 41 and a braided wire connecting portion 42 formed behind the rectangular tube 41. The braided wire connecting portion 42 is in the form of a flat plate and the braided wire 60 is connected electrically and/or mechanically thereto, such as by resistance welding.

The rectangular tube 41 includes a bottom wall 43, two side walls 44 standing up perpendicularly from opposite sides of the bottom wall 43 and a ceiling wall 45 extending from the upper edge of one of the side walls 44 toward the upper edge of the other side wall 44. The side walls 44 are parallel, and the ceiling wall 45 is parallel to the bottom wall 43.

Lower and upper resilient pieces 46 and 47 are arranged in the rectangular tube 41. The lower resilient piece 46 extends substantially straight and is arranged on the side of the bottom wall 43. The upper resilient piece 47 also extends substantially straight, but is arranged on the side of the ceiling wall 45. The lower and upper resilient piece 46 and 47 are substantially parallel and faces each other in the vertical direction. Thus, a male terminal 80 can be sandwiched resiliently by the upper and lower resilient pieces 46, 47. The lower resilient piece 46 extends back through the interior of the rectangular tube 41 by being folded into a U shape from the front edge of the bottom wall 43, and the upper resilient piece 47 extends back through the interior of the rectangular tube 41 by being folded into a U shape from the front edge of the ceiling wall 45.

A contact portion 48 is formed on a rear end of each resilient piece 46, 47. The contact portions 48 are formed into dome-shaped projections by being struck toward facing surfaces 49 of the lower and upper resilient pieces 46, 47 facing each other. Specifically, the contact portion 48 of the lower resilient piece 46 is formed by being struck from the side of the bottom wall 43 toward the side of the ceiling wall 45, and the contact portion 48 of the upper resilient piece 47 is formed by being struck from the side of the ceiling wall 45 toward the side of the bottom wall 43. Each contact portion 48 is arranged at such a position near the rear end of the rectangular tube 41 so as not to project back from the rear end, and is at substantially the same position in the front-back direction as the front end of a cantilever-like locking lance 28 when the locking lance 28 formed in the floating housing 21 is locked to the rear end of the ceiling wall 45 from behind.

The male terminal 80 that is inserted in a proper posture into the rectangular tube 41 from the front contacts each contact portion 48 while sliding in contact with the facing surface 49 of each resilient piece 46, 47. A distance between the respective contact portions 48 is smaller than a tab thickness of the flat plate-shaped male terminal 80, and a tapered tip 81 of the male terminal 80 is inserted between the contact portions 48. Thus, the male terminal 80 is inserted backward while pushing the respective resilient pieces 46, 47 apart in directions to move the contact portions 48 away from each other. A main body 82 connected to and behind the tip 81 of the male terminal 80 slides in contact with each contact portion 48, and each contact portion 48 is held resiliently in contact with the main body 82 of the male terminal 80 when the male terminal 80 reaches an insertion end position, as shown in FIG. 9. The tip 81 of the male terminal 80 projects farther back than the rear end of the ceiling wall 45 in this state. However, the tip 81 is protectively surrounded from opposite left and right sides by protection walls 44A extending back from the left and right side walls 44. Note that the protection walls 44A are coupled to both the rear end edges of the side walls 44 and the opposite sides of the bottom wall 43.

Lower and upper excessive deflection preventing portions 90, 91 are provided in the rectangular tube 41 for preventing the respective resilient pieces 46, 47 from being deflected and deformed excessively. The lower excessive deflection preventing portion 90 projects from the bottom wall 43 and the upper excessive deflection preventing portion 91 projects from the ceiling wall 45. The lower excessive deflection preventing portion 90 is formed by striking the bottom wall 43 toward the ceiling wall 45, and the upper excessive deflection preventing portion 91 is formed by striking the ceiling wall 45 toward the bottom wall 43. The lower and upper excessive deflection preventing portions 90, 91 are vertically symmetrical. Thus, the lower excessive deflection preventing portion 90 is described as a representative for overlapping parts.

The lower excessive deflection preventing portion 90 includes a front abutting portion 92 and a rear abutting portion 93 arranged behind the front abutting portion 92. The front and rear abutting portions 92, 93 contact the lower resilient piece 46 when the lower resilient piece 46 is deflected down from a proper state. Specifically, a tiny clearance is defined between the lower surface of the lower resilient piece 46 and the lower excessive deflection preventing portion 90 when the male terminal 80 is connected to the female terminal 40 in a proper insertion posture, and the lower surface of the lower resilient piece 46 is in a non-contact state with the lower excessive deflection preventing portion 90. Either of the front and rear abutting portions 92, 93 can contact the contact portion 48 from a side opposite to the male terminal 80. In this embodiment, the rear abutting portion 93 comes into line contact with the contact portion 48 from the side opposite the male terminal 80. Further, the front abutting portion 92 contacts a front part of the contact portion 48 on the lower resilient piece 46 from the side opposite to the male terminal 80. The lower excessive deflection preventing portion 90 has an abutting surface 94 between the front and rear abutting portions 92, 93 that is configured to come into surface contact with the lower resilient piece 46. Note that since the lower excessive deflection preventing portion 90 is formed by striking a part of the bottom wall 43 toward the lower resilient piece 46, it has higher rigidity than a functionally similar structure formed by cutting and bending.

Figure 8:
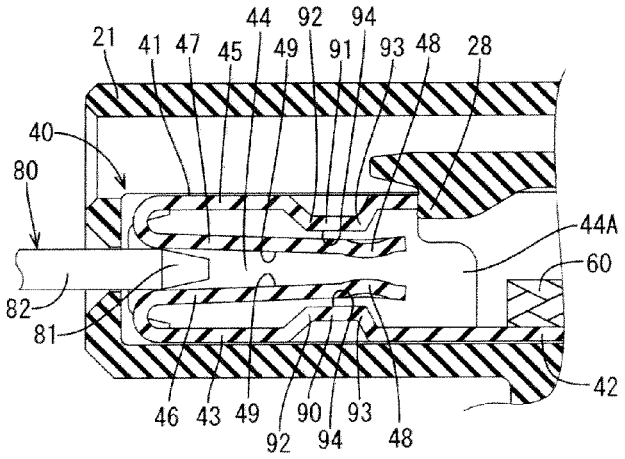
FIG. 8 is a section showing an intermediate state of inserting a male terminal into a female terminal.

The tip 81 is inserted between the facing surfaces 49 of the upper and lower resilient pieces 46, 47 and contacts the contact portions 48 when the male terminal 80 is inserted into the rectangular tube 41 in the proper posture, as shown in FIG. 8. Thus, the resilient pieces 46, 47 deflect away from each other. When the male terminal 80 reaches a proper insertion position, as shown in FIG. 9, the undersides of the contact portions 48 on the respective resilient pieces 46, 47 are in a non-contact state with upper and lower rear abutting portions 93.

Figure 9:
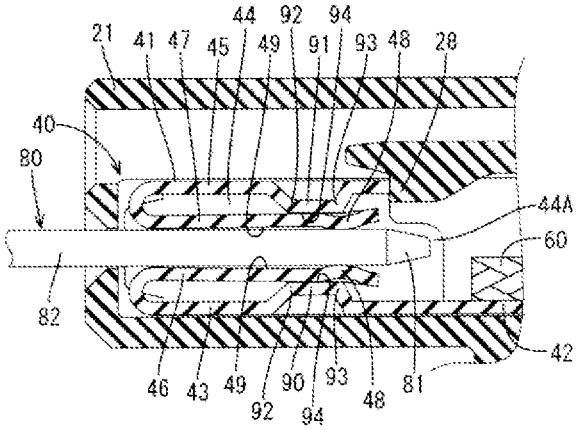
FIG. 9 is a section showing a state where the male terminal is inserted in the female terminal.

The male terminal 80 may be swung undesirably and displaced down after reaching the proper insertion position shown in FIG. 9. In this case, the lower resilient piece 46 is displaced slightly down into line contact with both the front and rear abutting portions 92, 93 from a state where the lower resilient piece 46 is in line contact with only the rear abutting portion 93 of the lower excessive deflection preventing portion 90. Thus, the lower excessive deflection preventing portion 90 is held in surface contact with the abutting surface 94, but the contact portion 48 is not displaced largely down. Contrary to this, if the tip 81 of the male terminal 80 is swung and displaced up, the upper resilient piece 47 is displaced slightly up and comes into line contact with both the front and rear abutting portions 92, 93 from a state where the upper resilient piece 47 is in line contact with only the rear abutting portion 93 of the upper excessive deflection preventing portion 91. Thus, the upper excessive deflection preventing portion 91 is held in surface contact with the abutting surface 94, but the contact portion 48 is not displaced largely up. Hence, even if the tip 81 of the male terminal 80 is swung and displaced in the vertical direction, a contact pressure between the male terminal 80 and each contact portion 48 does not change significantly.

Figure 10:
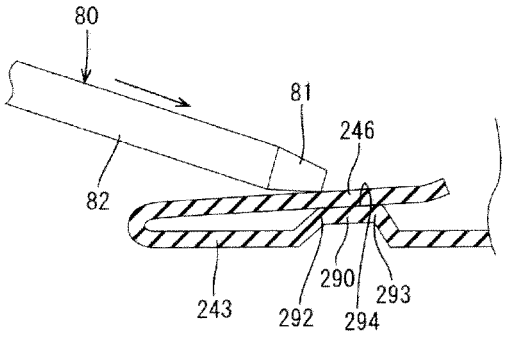
FIG. 10 shows a state where the male terminal is approaching a resilient piece from an oblique front side in a simplified manner to describe a function of this embodiment in an easy-to-understand manner.
Figure 11:
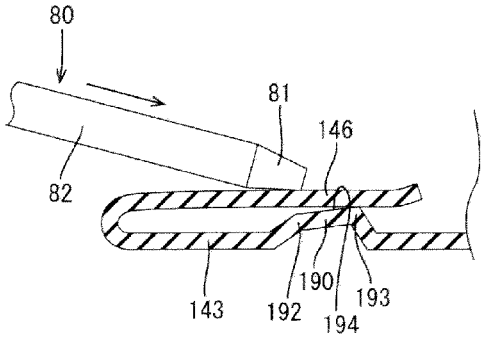
FIG. 11 shows a state where the resilient piece is pushed by the male terminal from a state of FIG. 10 to contact a rear abutting portion of an excessive deflection preventing portion.
Figure 12:
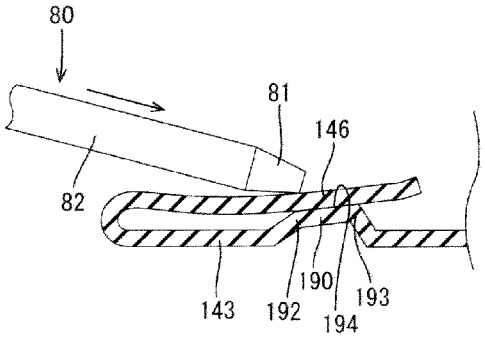
FIG. 12 shows a state where the resilient piece is pushed further by the male terminal from a state of FIG. 11 to contact both front and rear abutting portions of the excessive deflection preventing portion.

The configuration of the female terminal is drawn in a simplified manner in FIGS. 10 and 12 to describe a function of the excessive deflection preventing portion 90 in an easy-understand manner. Components corresponding to those of the embodiment are denoted by reference signs obtained by 100 to the respective reference signs. When the tip 81 of the male terminal 80 approaches a lower resilient piece 146 in an insertion posture facing obliquely down, as shown in FIG. 10, the lower resilient piece 146 is pushed down by the tip 81 of the male terminal 80, as shown in FIG. 11. Thus, the lower resilient piece 146 is held in contact with only a rear abutting portion 193. When pushed farther down by the tip 81 of the male terminal 80, the lower resilient piece 146 comes into line contact with both front and rear contact portions 192,193 and comes into surface contact with an abutting surface 194 as shown in FIG. 12. At this time, the lower resilient piece 146 receives a stress from the abutting surface 194, but the stress does not concentrate on one position of the lower resilient piece 146 and is distributed over the substantially entire contact surface with the abutting surface 194 of the lower resilient piece 146. Thus, the abutting surface 194 prevents excessive deflection while suppressing the plastic deformation of the lower resilient piece 146. Further, a part of the lower resilient piece 146 before the contact surface with the abutting surface 194 on the lower resilient piece 146 is displaced somewhat and deflected out and down, but this outward or downward displacement amount is set so that the lower resilient piece 146 is not deformed plastically. Similarly, when the tip 81 of the male terminal 80 approaches an upper resilient piece in an insertion posture facing obliquely up although not shown, a stress does not concentrate on one position of the upper resilient piece and is distributed over the entire contact surface with an abutting surface of the upper resilient piece. Thus, it is possible to prevent excessive deflection while suppressing the plastic deformation of the upper resilient piece by the abutting surface.

As described above, the excessive deformation of the resilient piece 46, 47 can be prevented at the front and rear abutting portions 92, 93 of the excessive deflection preventing portion 90, 91. Thus, a seated posture of the resilient piece 46, 47 on the excessive deflection preventing portion 90, 91 is stable. For example, if the resilient piece 46, 47 comes into contact with an abutting portion at one position, the resilient piece 46, 47 is deflected easily at both front and rear sides of this abutting portion. Contrary to this, if the resilient piece 46, 47 comes into contact with the abutting portions 92, 93 at two positions, the resilient piece 46, 47 is arranged to extend along a straight line connecting the abutting portions 92, 93 and the excessive deflection of the resilient piece 46, 47 is prevented at least between the abutting portions 92, 93.

Further, a stress is more distributed when the resilient piece 46, 47 contact the abutting portions 92, 93 at two positions than when it contacts the abutting portion at one position. Thus, the resilient piece 46, 47 is difficult to deflect and difficult to plastically deform at each abutting portion 92, 93. Therefore, a displacement amount associated with the deflection of the resilient piece 46, 47 becomes smaller and a contact pressure with the male terminal 80 becomes stable. As a result, performance of the resilient piece 46, 47 can be maintained within a range where the resilient piece 46, 47 is not deformed plastically.

The resilient piece 46, 47 may include the contact portion 48 configured for resiliently contacting the male terminal 80 and either one of the front and rear abutting portions 92, 93 may be configured to contact the contact portion 48 from the side opposite to the male terminal 80.

The contact pressure with the male terminal 80 is applied from the contact portion 48 of the resilient piece 46, 47 to press the male terminal 80. Thus, a displacement of the contact portion 48 is suppressed and the contact pressure with the male terminal 80 becomes more stable by the contact of either one of the abutting portions 92, 93 with the contact portion 48.

Either of the front and rear abutting portions 92, 93 may be configured to come into line contact with the contact portion 48 from the side opposite the male terminal 80. Thus, the rolling of the resilient piece 46, 47 at the position of the contact portion 48 (seesaw-like swinging movements of opposite lateral parts of the resilient piece 46, 47 when viewed in an inserting direction of the male terminal 80) is suppressed. Therefore the seated position of the resilient piece 46, 47 on the excessive deflection preventing portion 90, 91 is more stable.

The excessive deflection preventing portion 90, 91 may include the abutting surface 94 between the front and rear abutting portions 92, 93 for coming into surface contact with the resilient piece 46, 47. Thus, a stress received from the excessive deflection preventing portion 90, 91 by the resilient piece 46, 47 is distributed widely.

The excessive deflection preventing portion 90, 91 may be formed by striking a part of a peripheral wall 43, 45 toward the resilient piece 46, 47. Accordingly, the rigidity of the excessive deflection preventing portion 90, 91 can be enhanced more as compared with the case where the excessive deflection preventing portion 90, 91 is formed by cutting and bending.

The pair of resilient pieces 46, 47 may be provided to resiliently sandwich the male terminal 80. Thus, even if the male terminal 80 is displaced in a deflecting direction of the resilient piece 46, 47 and a contact pressure from one resilient piece is reduced, a contact pressure from the other resilient piece is increased. Thus, a reduction of the contact pressure can be prevented regardless of the displacement of the male terminal 80.

The technology disclosed in this specification is not limited to the above described and illustrated embodiment. For example, the following various modes also are included.

Although the tubular portion is illustrated to have a rectangular tube shape in the above embodiment, it may have a hollow cylindrical shape or a tubular shape with five or more angles.

The abutting surface 94 of excessive deflection preventing portion 90, 91 between the front and rear abutting portions 92, 93 is illustrated to achieve surface contact with the resilient piece 46, 47. However, the excessive deflection preventing portion may contact the resilient piece 46, 47 only at two positions, i.e. at the front and rear abutting portions 92, 93.

The front and rear abutting portions 92, 93 of the excessive deflection preventing portion 90, 91 are illustrated to come into line contact with the resilient piece 46, 47 in the above embodiment. However, the excessive deflection preventing portion may be such that the front and rear abutting portions come into point contact with the resilient piece 46, 47 or one of the front and rear abutting portions comes into point contact with the resilient piece 46, 47 and the other comes into line contact with the resilient piece 46, 47.

The excessive deflection preventing portion 90, 91 is formed by striking in the above embodiment. However, the excessive deflection preventing portion may be formed by cutting and bending a part of the side wall 44.

Upper and lower resilient pieces 46, 47 are illustrated to sandwich the male terminal 80 resiliently in the above embodiment. However, the male terminal 80 may be sandwiched resiliently between the lower resilient piece 46 and the ceiling wall 45 without providing the upper resilient piece 47.

Each rear abutting portion 93 is not in line contact with each resilient piece 46, 47 when the male terminal 80 is inserted properly into the rectangular tube 41. However, each rear abutting portion 93 may be in contact with each resilient piece 46, 47 or each abutting surface 94 may be in surface contact with each resilient piece 46, 47.

Figure 13:
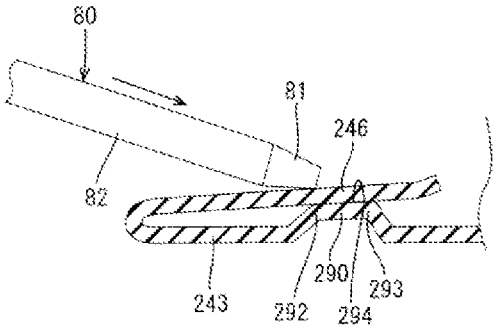
FIG. 13 shows a state where a resilient piece is pushed by a male terminal to simultaneously contact with both front and rear abutting portions of an excessive deflection preventing portion from the beginning in a simplified manner to describe a function of another embodiment in an easy-to-understand manner.

When the male terminal 80 makes an undesirable movement of being inserted obliquely down, as shown in FIGS. 10 to 12, the lower resilient piece 146 first contacts the rear abutting portions 193 and, subsequently contacts both the front and rear abutting portions 192, 193. However, as shown in FIG. 13, a lower resilient piece 246 may simultaneously contact both front and rear abutting portions 292, 293 and come into surface contact with an abutting surface 294 from the beginning. In this case, since a part of the lower resilient piece 246 before a contact surface with the abutting surface 294 is in a natural state without being deflected, the plastic deformation of the lower resilient piece 246 can be prevented more reliably. Note that the configuration of the female terminal is drawn in a simplified manner to describe a function of an excessive deflection preventing portion 90 in an easy-to-understand manner and components corresponding to those of the embodiment are denoted by reference signs obtained by adding 200 to the respective reference signs.

REFERENCE SIGNS

10 . . . shield connector
40 . . . female terminal
41 . . . rectangular tube (tubular portion)
43 . . . bottom wall (peripheral wall)
45 . . . ceiling wall (peripheral wall)
46 . . . lower resilient piece (resilient piece)
47 . . . upper resilient piece (resilient piece)
48 . . . contact portion
80 . . . male terminal
90 . . . lower excessive deflection preventing portion (excessive deflection preventing portion)
91 . . . upper excessive deflection preventing portion (excessive deflection preventing portion)
92 . . . front abutting portion
93 . . . rear abutting portion
94 . . . abutting surface

What is claimed is:

1. A female terminal to be connected to a male terminal, comprising:

a tubular portion having opposite front and rear ends spaced apart in a front-back direction and at least first and second opposed peripheral walls extending between the front and rear ends;

a first resilient piece arranged in the tubular portion and extending substantially in the front-back direction from the first peripheral wall at the front end of the tubular portion and extending toward the rear end of the tubular portion, a contact portion formed on a rear end of the first resilient piece and configured for resiliently contacting the male terminal; and a first excessive deflection preventing portion projecting into the tubular portion from the first peripheral wall and toward the first resilient piece, the first excessive deflection preventing portion including front and rear abutting portions extending substantially linearly in directions transverse to the front-back direction, the rear abutting portion being aligned with the contact portion of the first resilient piece and the front abutting portion being spaced from the rear abutting portion and between the rear abutting portion and the front of the tubular portion, wherein at least one of the front and rear abutting portions of the first excessive deflection preventing portion contacts the first resilient piece from a side opposite the male terminal to achieve at least a line contact with the first resilient piece when the male terminal is connected to the female terminal to prevent the first resilient piece from being deflected excessively and to prevent displacement of the male terminal.

2. The female terminal of claim 1, wherein the first excessive deflection preventing portion includes an abutting surface between the front and rear abutting portions and the abutting surface is configured to achieve surface contact with the first resilient piece.

3. The female terminal of claim 1, wherein the first excessive deflection preventing portion is formed by striking a part of the first peripheral wall toward the first resilient piece.

4. The female terminal of claim 1, wherein the first resilient piece is unitary with the first peripheral wall and is bent into the tubular portion from the front end of the tubular portion, the rear end of the first resilient piece is spaced from the peripheral walls.

5. The female terminal of claim 1, wherein the first peripheral wall has a planar portion and the first excessive deflection preventing portion projects into the tubular portion from the planar portion of the first peripheral wall, the first excessive deflection preventing portion being dimensioned and disposed to prevent the rear end of the first resilient piece from contacting the planar portion of the peripheral wall.

6. A connector, comprising:

the female terminal of claim 1; and a male terminal configured to be inserted into the tubular portion in the front-back direction and into contact with at least the contact portion of the first resilient piece and to resiliently deform the first resilient piece, wherein at least one of the front and rear abutting portions of the first excessive deflection preventing portion contacts the first resilient piece at a position aligned with the contact portion when the male terminal is connected to the female terminal to prevent the first resilient piece from being deflected excessively and to prevent displacement of the male terminal.

7. The connector of claim 6, wherein the male terminal is sandwiched between the first and second resilient pieces.

8. The connector of claim 1, further comprising:

a second resilient piece arranged in the tubular portion and extending substantially in the front-back direction from the second peripheral wall at the front end of the tubular portion and extending toward the rear end of the tubular portion, a contact portion formed on a rear end of the second resilient piece and configured for resiliently contacting the male terminal; and a second excessive deflection preventing portion projecting into the tubular portion from the second peripheral wall and toward the second resilient piece, the second excessive deflection preventing portion including front and rear abutting portions extending substantially linearly in directions transverse to the front-back direction, the rear abutting portion being aligned with the contact portion of the second resilient piece and the front abutting portion being spaced from the rear abutting portion and between the rear abutting portion and the front of the tubular portion, wherein at least one of the front and rear abutting portions of the second excessive deflection preventing portion contacts the second resilient piece from a side substantially opposite to the male terminal when the male terminal is connected to the female terminal to prevent the second resilient piece from being deflected excessively and to prevent displacement of the male terminal.

9. The female terminal of claim 8, wherein at least one of the front and rear abutting portions of the second excessive deflection preventing portion is configured to achieve a substantially line contact with the second resilient piece.

10. The female terminal of claim 8, wherein the second excessive deflection preventing portion includes an abutting surface between the front and rear abutting portions and the abutting surface of the second excessive deflection preventing portion is configured to achieve surface contact with the second resilient piece.

11. The female terminal of claim 8, wherein the second resilient piece is unitary with the second peripheral wall and is bent into the tubular portion from the front end of the tubular portion, the rear end of the second resilient piece is spaced from the peripheral walls.

* * * * *